US006539646B2

(12) United States Patent
Brooks et al.

(10) Patent No.: US 6,539,646 B2
(45) Date of Patent: Apr. 1, 2003

(54) FOOTWEAR SOLE WITH INTEGRAL DISPLAY ELEMENT

(75) Inventors: Mike Brooks, Nelsonville, OH (US); Allen G. Sheets, Albany, OH (US)

(73) Assignee: Rocky Shoes & Boots, Inc., Nelsonville, OH (US)

( * ) Notice: Subject to any disclaimer, the term of this patent is extended or adjusted under 35 U.S.C. 154(b) by 0 days.

(21) Appl. No.: 09/758,583

(22) Filed: Jan. 11, 2001

(65) Prior Publication Data

US 2002/0088143 A1 Jul. 11, 2002

(51) Int. Cl.[7] ..... A43B 23/00; A43B 3/28; A43B 13/04; A43B 13/16

(52) U.S. Cl. ..... 36/30 R; 36/136; 36/112; 36/137

(58) Field of Search ..... 36/30 R, 112, 36/132, 136, 137, 31, 25 R, 11.5, 28

(56) References Cited

U.S. PATENT DOCUMENTS 2,755,567 A * 7/1956 Rudine ..... 36/11.5
2,759,284 A * 8/1956 Santisi ..... 36/11.5
2,889,639 A * 6/1959 Rudine ..... 36/11.5
3,082,556 A 3/1963 Schwartz et al.
3,748,758 A * 7/1973 Wilchusky ..... 36/136
4,050,167 A 9/1977 Senter
4,050,168 A 9/1977 Pace
4,712,314 A 12/1987 Sigoloff
4,845,863 A * 7/1989 Yung-Mao ..... 36/30 R
5,331,753 A 7/1994 Rodibaugh
5,528,842 A * 6/1996 Ricci et al. ..... 36/30 R
5,775,005 A * 7/1998 McClelland ..... 36/31
5,822,885 A 10/1998 Loverin
5,930,921 A * 8/1999 Sorofman et al. ..... 36/137
6,038,790 A * 3/2000 Pyle et al. ..... 36/30 R
6,050,007 A * 4/2000 Angelieri et al. ..... 36/137
6,055,747 A * 5/2000 Lombardino ..... 36/28
6,119,371 A * 9/2000 Goodwin et al. ..... 36/28

* cited by examiner

*Primary Examiner*—Anthony D. Stashick
(74) *Attorney, Agent, or Firm*—Porter, Wright, Morris & Arthur, LLP

(57) ABSTRACT

A footwear sole is provided that comprises a first layer and a display element integral with the first layer. The first layer has a lower surface and an upper surface and is at least semi-transparent such that the display element is observable through the first layer.

15 Claims, 9 Drawing Sheets

FOOTWEAR SOLE WITH INTEGRAL DISPLAY ELEMENT

FIELD OF THE INVENTION

The present invention generally relates to a footwear sole, and, more particularly, to a footwear sole with an integral display element.

BACKGROUND OF THE INVENTION

It is known to provide decorations, embossed figures, and the like on the outer surface of soles for footwear for decoration These designs are generally worn off or degraded quickly after use of the footwear.

It is also known to provide an insert in a footwear sole for a decorative effect. For example, U.S. Pat. No. 4,712,314 discloses a decorative insert protected by a clear plastic element. However, such an insert covers only a small area of the total area of the sole and only provides viewing of the insert through the clear plastic insert. In addition, such an insert increases the cost and complexity of production of a footwear sole.

Accordingly, there is a need in the art for a decorative footwear sole that does not wear off during wear, that is observable through a large portion of the sole, and that is easily manufactured.

SUMMARY OF THE INVENTION

The present invention provides a footwear sole with an integral display element which overcomes at least some of the above-noted problems of the related art. According to the present invention, a footwear sole is provided that comprises a first layer and a display element integral with the first layer. The first layer has a lower surface and an upper surface and is at least semi-transparent such that the display element is observable through the first layer. The footwear sole preferably further comprises a second layer attached to the first layer at the upper surface of the first layer.

In one preferred embodiment of the present invention, the upper surface of the first layer is substantially defined by the integral display element. In another preferred embodiment of the present invention, the display element is at least partially porous.

According to another aspect of the present invention, an article of footwear is provided that comprises an upper defining a volume for enclosing a wearer's foot and a sole attached to the upper. The sole comprises a first layer and a display element integral with the first layer. The first layer has a lower surface and an upper surface and is at least semi-transparent such that the display element is observable through the first layer.

According to a further aspect of the present invention, an article of footwear is provided that comprises a sole and an upper defining a volume for enclosing a wearer's foot. The sole comprises a first layer having a lower surface and an upper surface, a display element integral with the first layer, and a second layer having an upper surface and a lower surface. The first layer is at least semi-transparent such that the display element is observable through the first layer. The lower surface of the second layer is attached to the upper surface of the first layer and the upper is attached to the upper surface of the second layer.

According to yet another aspect of the present invention, a footwear sole is provided that comprises a first layer and a display element. The first layer has a lower surface, an upper surface, and a perimeter. The display element is positioned above the lower surface of the first layer, is connected to the first layer, and extends to the perimeter of the first layer. The first layer is at least semi-transparent such that the display element is observable through the first layer.

Additional features and advantages of various preferred embodiments will be better understood in view of the detailed description provided below.

DETAILED DESCRIPTION OF CERTAIN PREFERRED EMBODIMENTS

Figure 1:
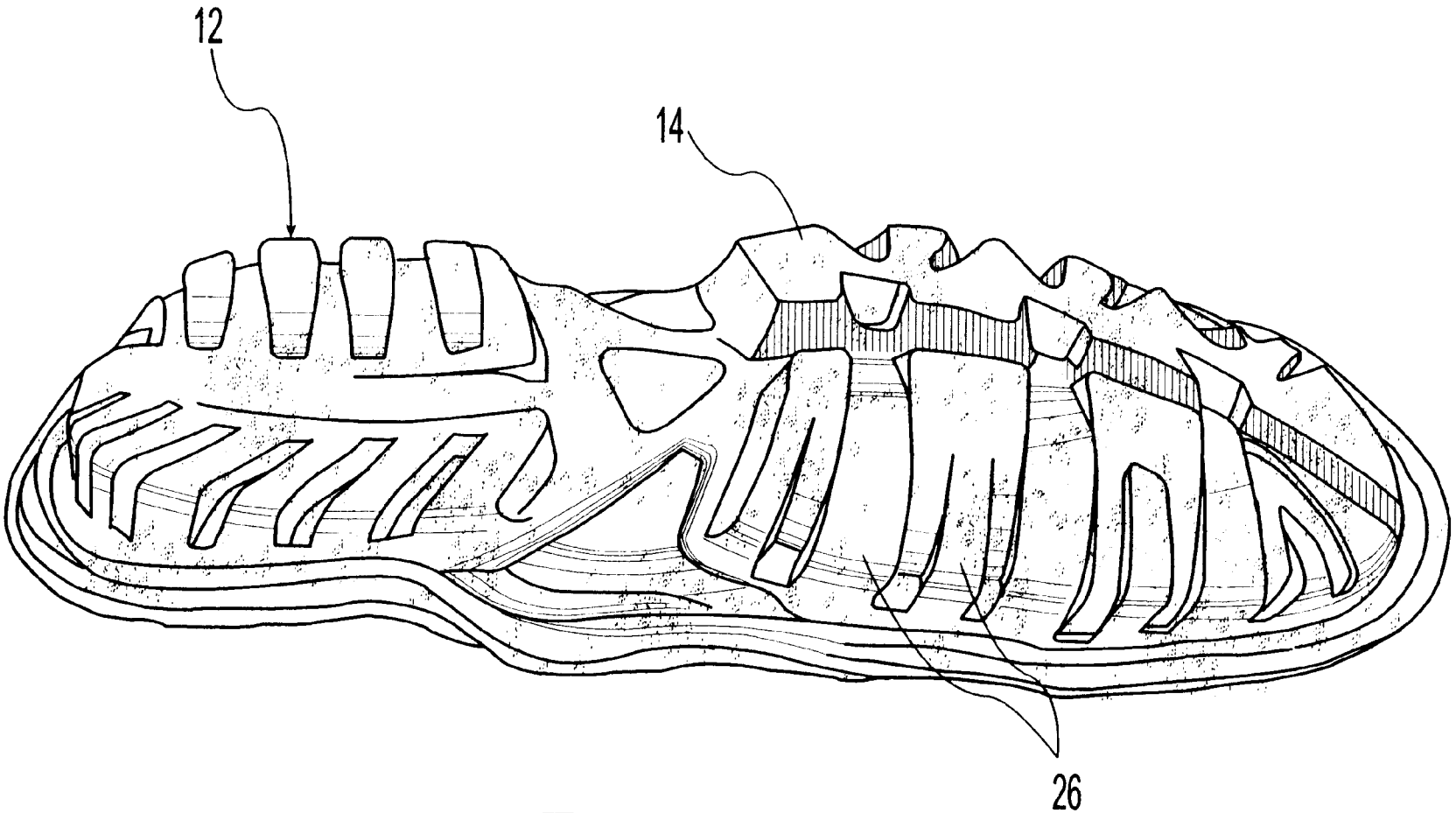
FIG. 1 is a bottom perspective view of a portion of a footwear sole according to a preferred embodiment of the present invention showing a first layer with an integral display element.
Figure 2:
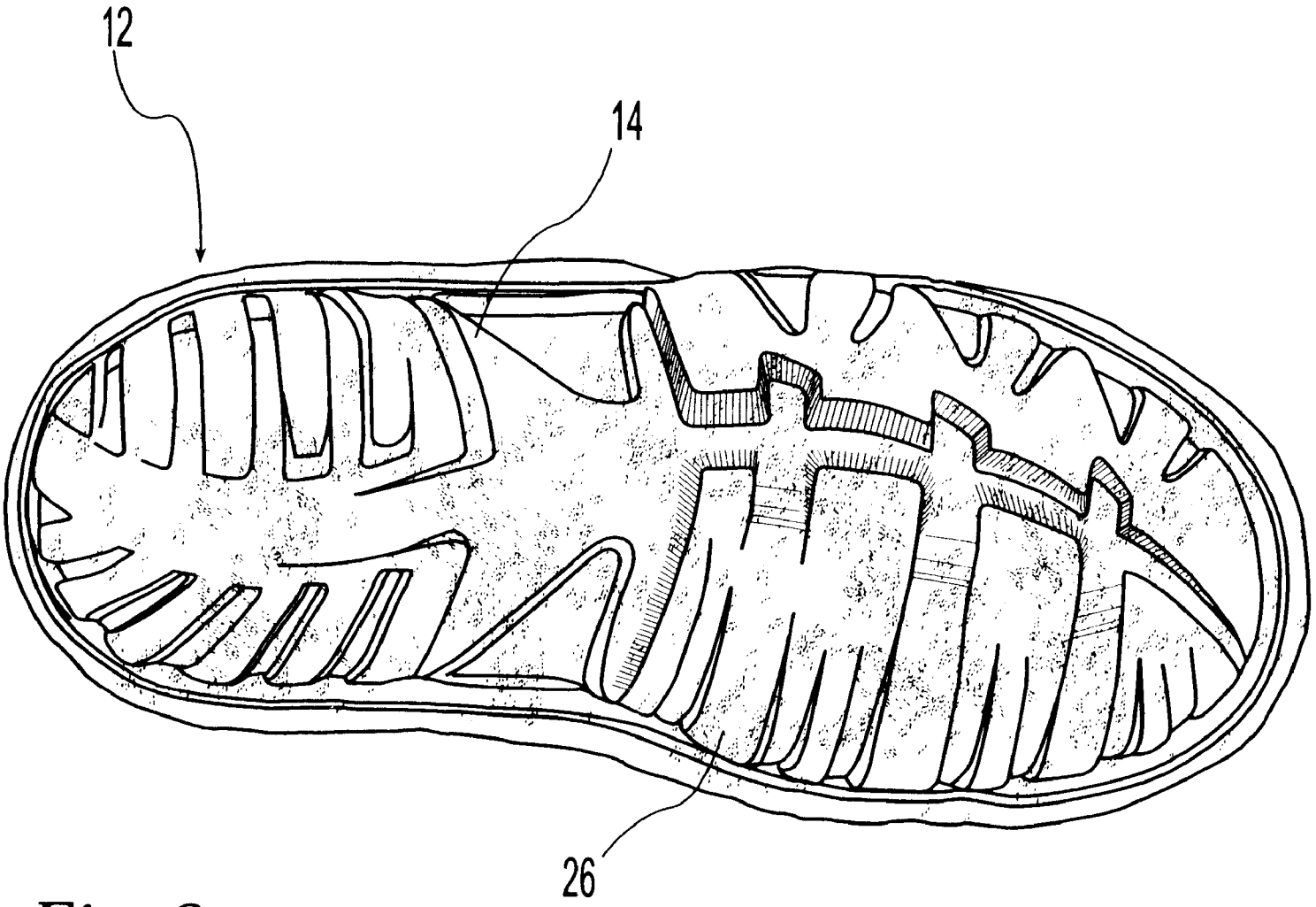
FIG. 2 is a bottom elevational view of the first layer of FIG. 1.
Figure 3:
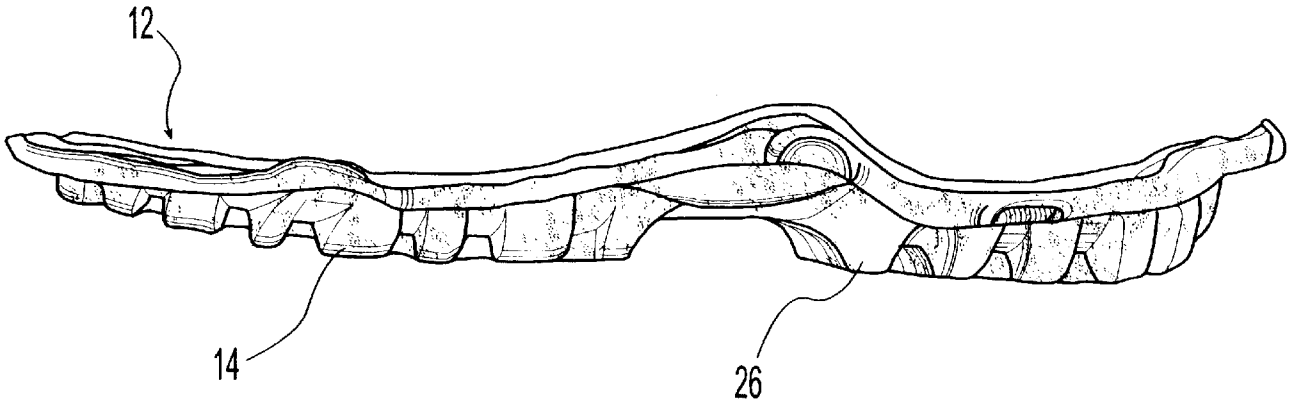
FIG. 3 is a side view of the first layer of FIG. 1.

The following detailed discussion of various alternative and preferred embodiments will illustrate the general principles of the present invention with reference to a sole of an article of footwear such as, for example, a shoe or boot sole. Other embodiments suitable for other applications will be readily apparent to those skilled in the art given the benefit of this disclosure.

Referring now to the drawings, FIGS. 1–10 together illustrate a preferred embodiment of a footwear sole or outsole 10 according to the present invention. The footwear sole 10 preferably comprises a first layer 12 with a lower surface 14 (FIGS. 1 and 2) and an upper surface 16 (FIGS. 4 and 5), a display element 18 integral with the first layer 12, and a second layer 20 attached to the first layer 12 at the upper surface 16 of the first layer 12. The first layer 12 is illustrated without the second layer 20 in FIGS. 1–6 and with the second layer 20 in FIGS. 7–10. The display element 18 is illustrated separately from the first layer 12 in FIG. 6. While the illustrated embodiments of the present invention are particularly adapted for use as a footwear sole, it is noted that principles of the invention are applicable to other applications with a display element observable through an outer layer.

Figure 4:
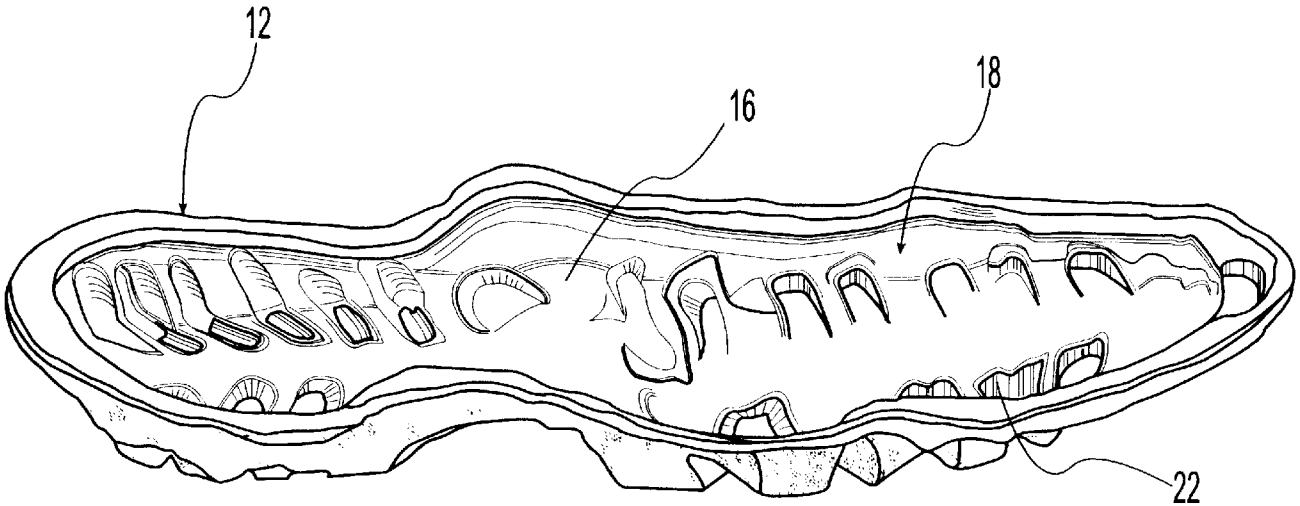
FIG. 4 is a top perspective view of the first layer of FIG. 1.
Figure 5:
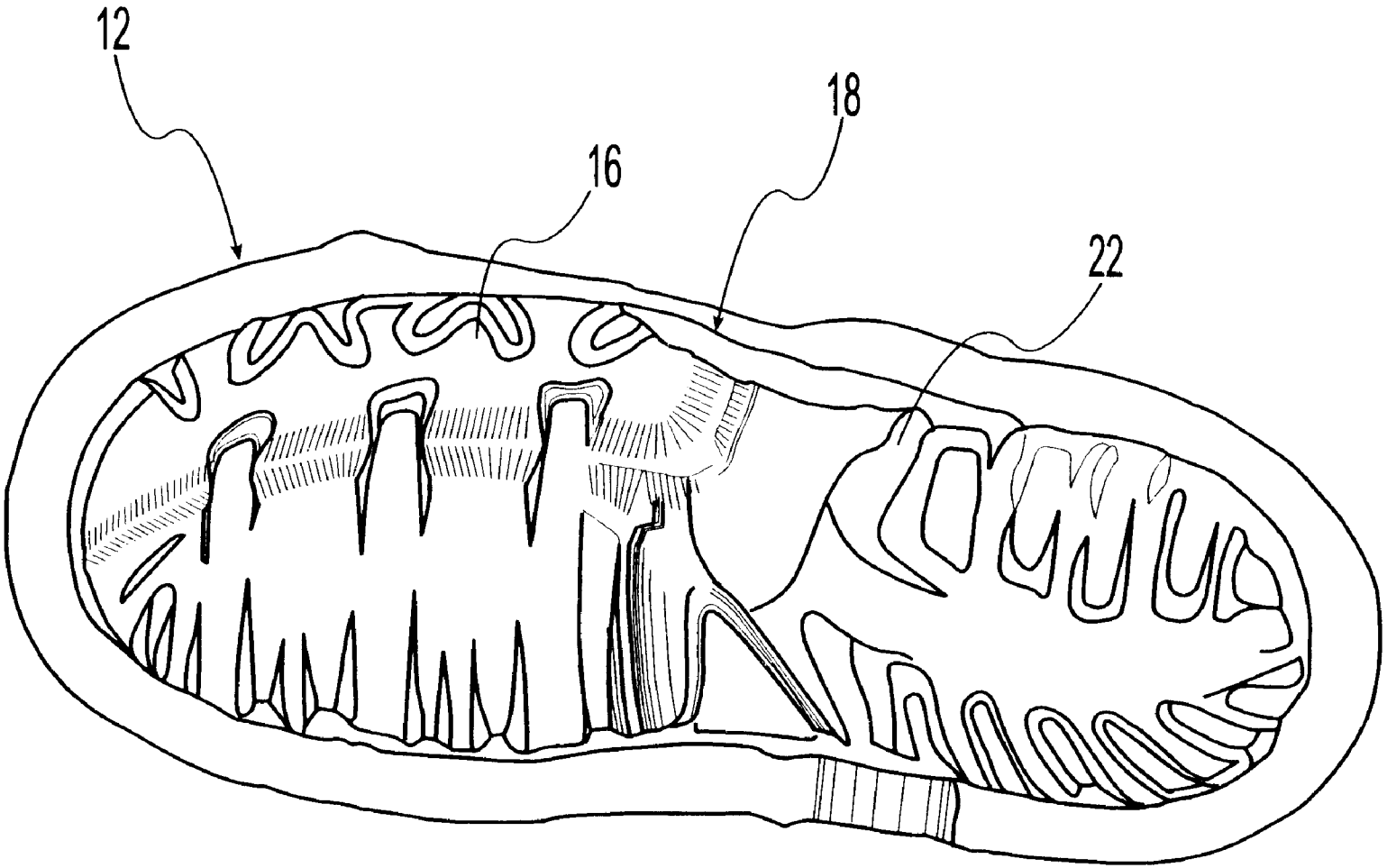
FIG. 5 is a top elevational view of the first layer of FIG. 1.
Figure 6:
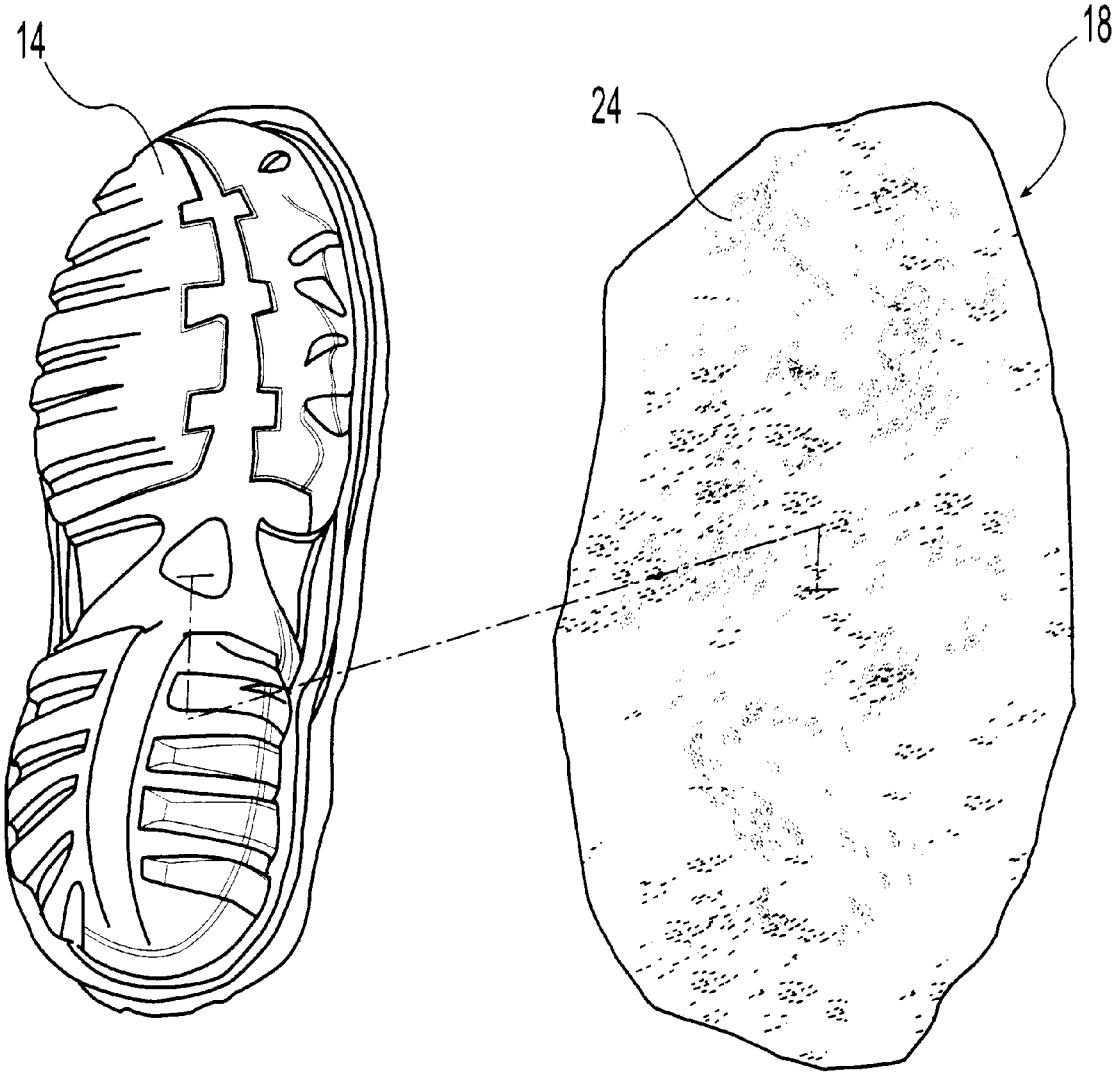
FIG. 6 is an exploded perspective view of the first layer of FIG. 1 illustrating the first layer and the display element disassembled.
Figure 7:
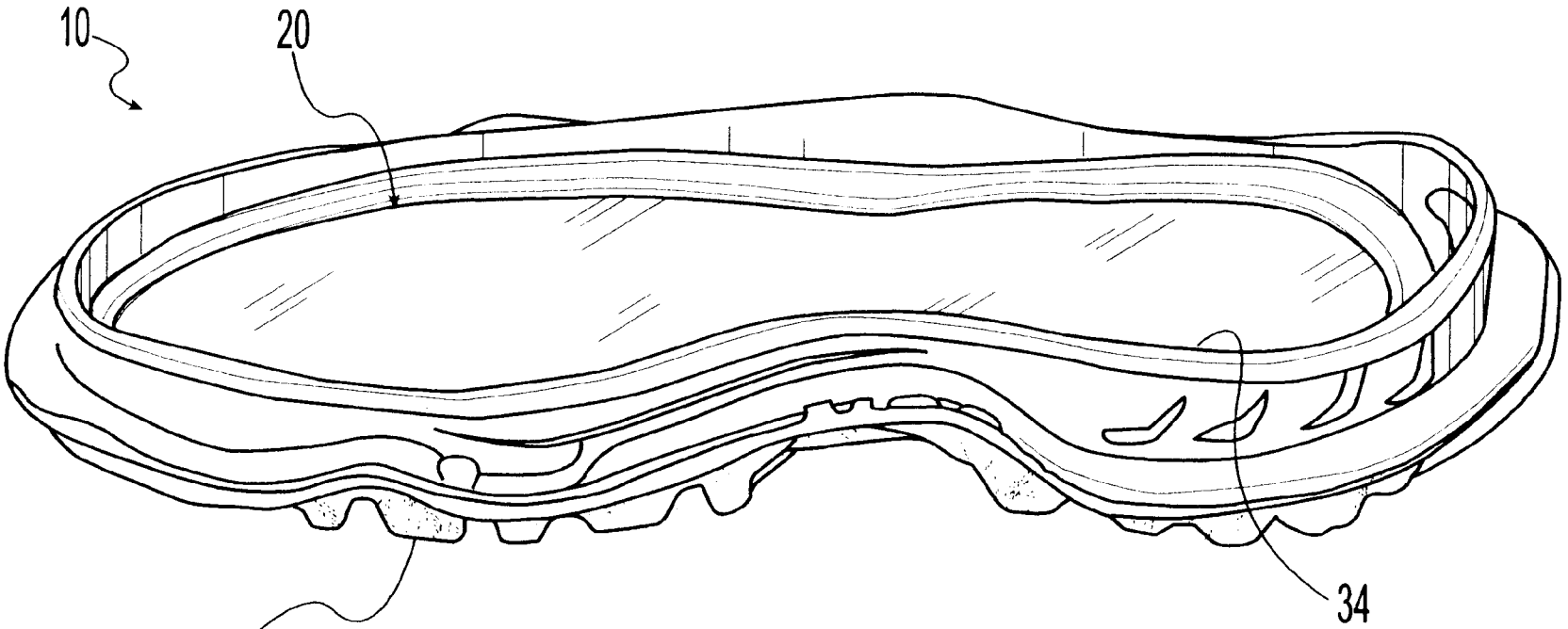
FIG. 7 is a perspective view of a footwear sole with an integral display element according to a preferred embodiment of the present invention and shown with a second layer and a first layer.
Figure 8:
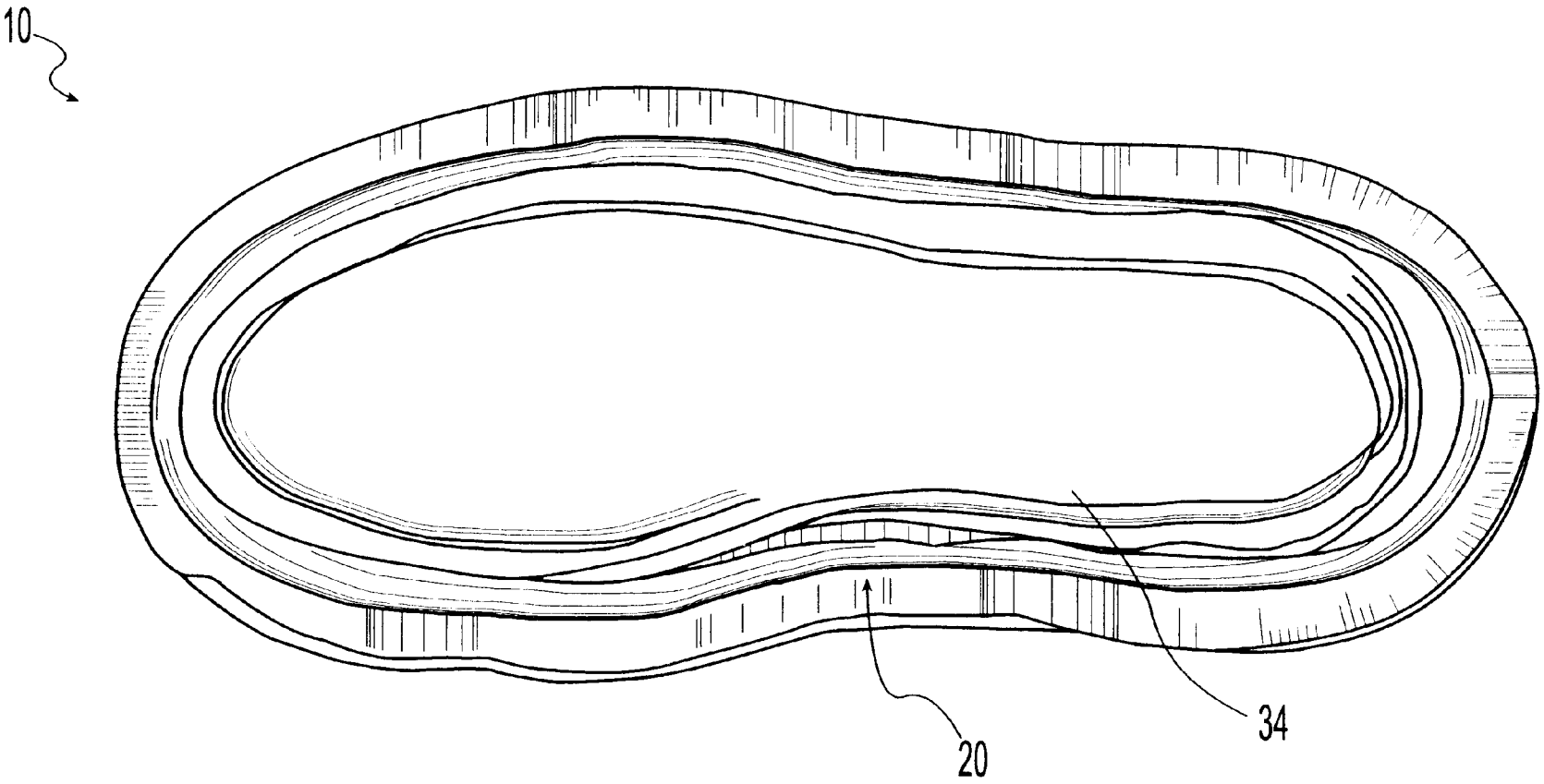
FIG. 8 is a top view of the footwear sole of FIG. 7.

In the preferred embodiment and as best illustrated in FIGS. 4 and 5, the shape of the display element 18 generally follows the shape of the upper surface 16 of the first layer 12. The display element 18 is preferably connected to the first layer 12 at a position above the lower surface 14 and preferably extends to a perimeter 23 (FIG. 2) of the first layer 12. Preferably, at least one upper surface 22 (FIGS. 4 and 5) or lower surface 24 (FIG. 6) of the display element 18 defines an area that is substantially equal to an area defined by the upper surface 16 of the first layer 12. As discussed in more detail below, the display element 18 is integral with the first layer 12. The display element 18 may be partially or wholly embedded in the first layer 12 and is preferably at least partially porous. The display element 18 may be formed from fabric, cloth, webbing, or any other suitable material and may illustrate a solid color, a pattern, lettering or numbering, or any other design on one or both of the upper 22 or lower 24 surfaces. FIG. 6 illustrates an exploded perspective view of the first layer 12 and the display element 18 with a camouflage pattern on the lower surface 24. The upper surface 22 of the display element 18 need not contain the camouflage design because the upper surface 22 will not be visible through the first layer 12.

The upper surfaces 16, 22 of the first layer 12 and the integral display element 18 may be coextensive, partially coextensive, or even distinct. When the upper surfaces 16, 22 are coextensive, the upper surface 22 of the display element 18 is also the upper surface 16 of the first layer 12. When the display element 18 is entirely embedded in the first layer 12, the upper surfaces 16, 22 are distinct and the upper surface 16 of the first layer 12 is formed entirely from the material of the first layer 12. The upper surfaces 16, 22 may be partially coextensive, for example, when the display element 18 is partially embedded in the first layer 12 so that some portions of the upper surface 16 are defined by the display element 18 and other portions of the upper surface 16 are defined by the material of the first layer 12 (at positions where the display element 18 is embedded). As best illustrated in FIG. 5, when the upper surfaces 16, 22 of the first layer 12 and the display element 18 are substantially coextensive, the display element 18 will substantially define the upper surface 16 of the first layer 12.

The first layer 12 is at least semi-transparent such that the display element 18 is observable through the first layer 12. This means that the first layer 12 may be transparent, partially transparent, or even translucent as long as the display element 18 is observable through the first layer 12. Because the lower surface 14 of the first layer 12 will be the primary contact surface with the ground or other walking surface, the first layer 12 is preferably abrasion resistant, slip resistant, and flex-crack resistant. The lower surface 14 of the first layer 12 may also be provided with lugs 26 for traction. In the preferred embodiment, the first layer 12 is formed from a moldable thermoplastic or rubber, most preferably polyurethane or polyvinyl chloride.

In the preferred embodiment and as best illustrated in FIGS. 7–10, a lower surface (not shown) of the second layer 20 is attached to the upper surface 16 of the first layer 12. The second layer 20 is preferably added to provide cushioning for the sole 10. It is preferable that the second layer 20 have a lower density and a lower specific gravity than the density and specific gravity of the first layer 12 to create a dual density sole. The second layer 20 is preferably formed from a moldable thermoplastic (such as, for example, ethylene vinyl acetate), preferably with microscopic air bubbles entrained therein, or rubber (such as, for example, foam or sponge rubber). Although it is preferable to provide a second layer 20 to the footwear sole 10 to increase comfort, those skilled in the art will recognize that the footwear sole 10 of the present invention may be formed without the second layer 20.

Figure 9:
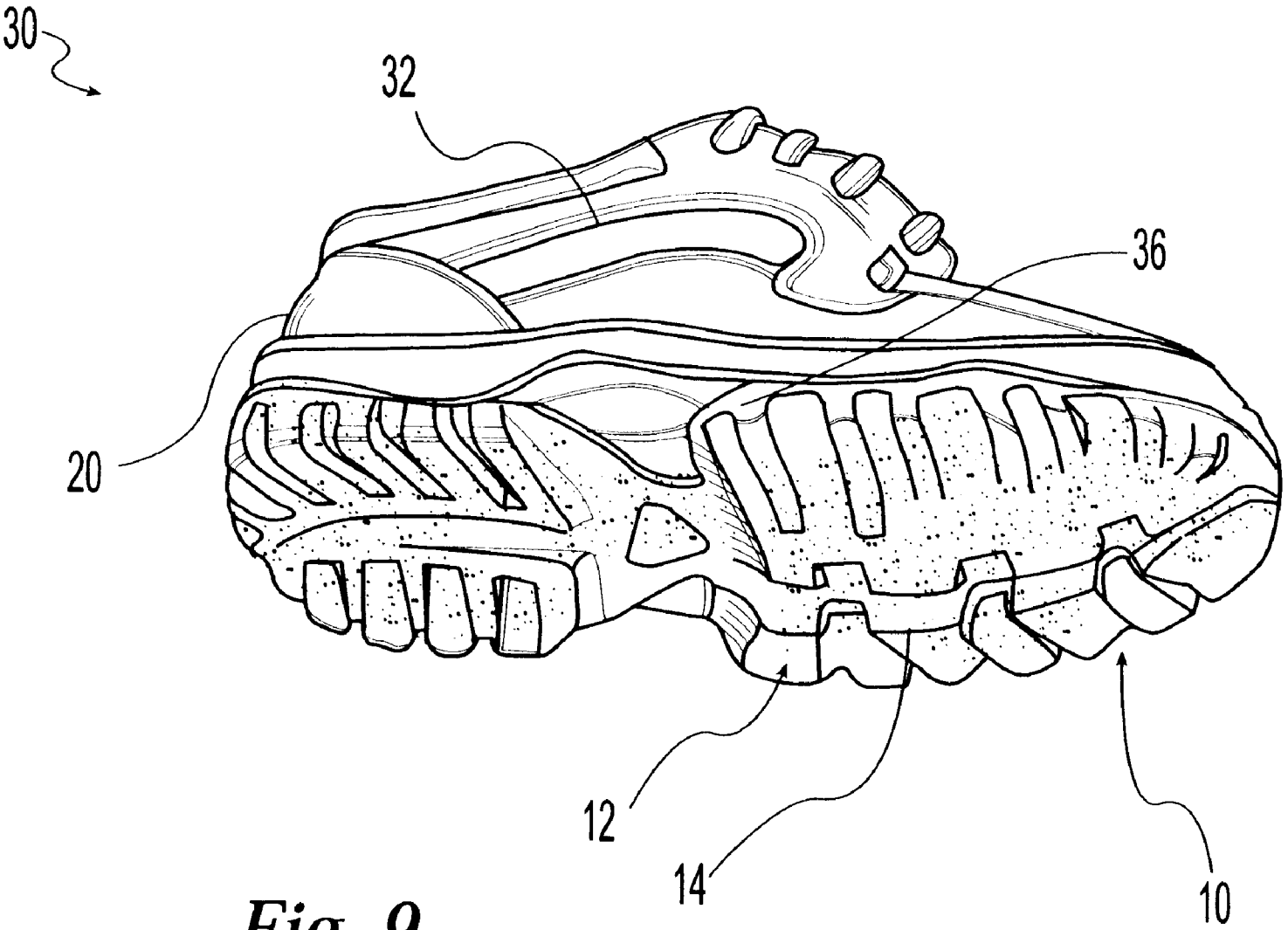
FIG. 9 is a perspective view of an article of footwear according to a preferred embodiment of the present invention.
Figure 10:
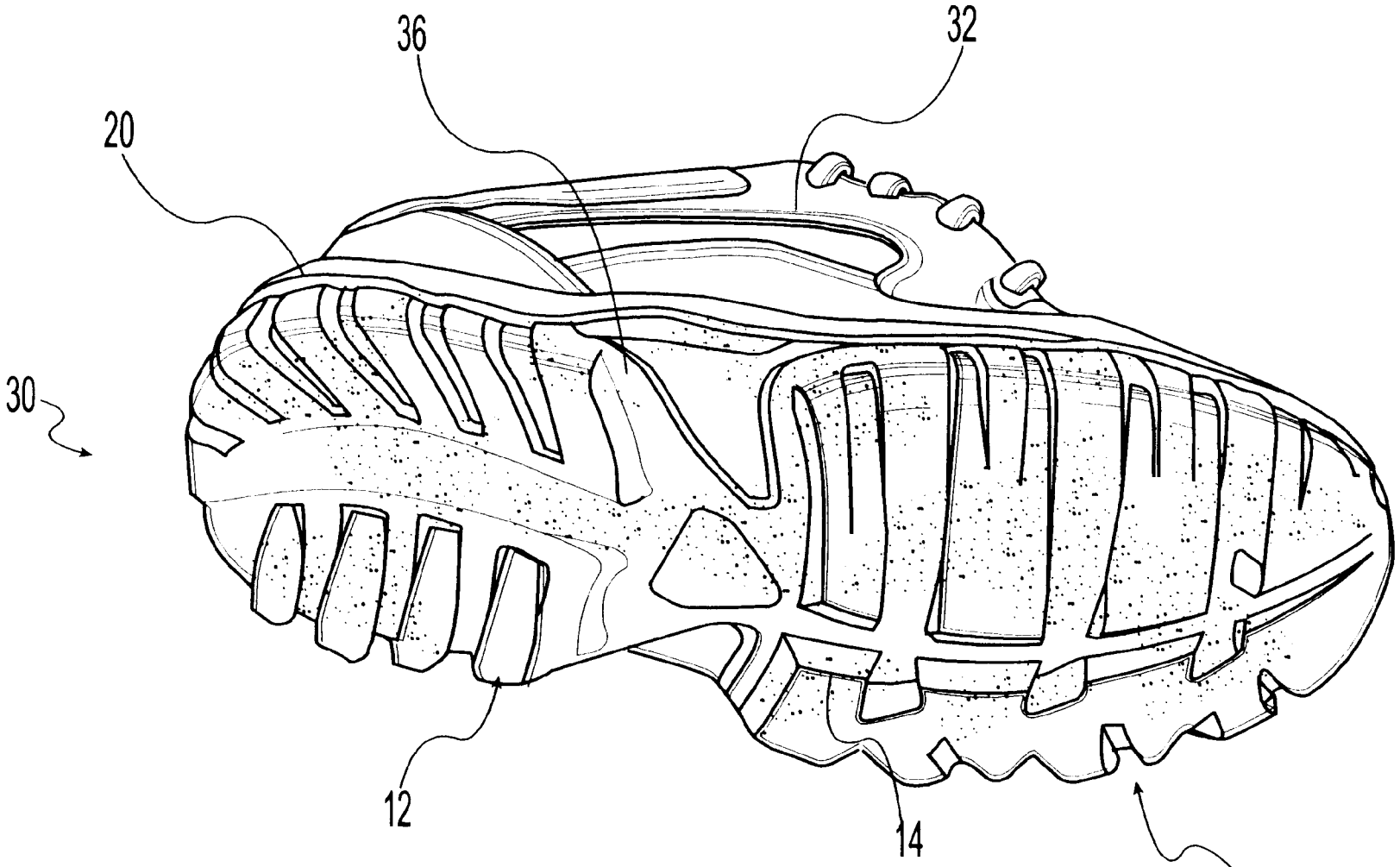
FIG. 10 is a another perspective view of the article of footwear of FIG. 9.

FIGS. 9 and 10 illustrate an article of footwear 30 comprising a footwear sole 10 in accordance with the present invention and an upper 32 defining a volume for enclosing a wearer's foot. The sole 10 is attached to the upper 32. When a second layer 20 is provided for the sole 10, the upper 32 is preferably attached to an upper surface 34 (FIGS. 7 and 8) of the second layer 20. As illustrated in the drawings, the display element 18 is observable through side surfaces 36 of the first layer 12 as well as the lower surface 14 of the first layer 12.

The footwear sole 10 and the article of footwear 30 may be manufactured in various ways. For example, the article of footwear 30 may be formed by direct attach injection molding where the upper 32 is attached to the sole 10 at the time the sole 10 is formed, or the sole 10 may be formed independently as a unit sole and then attached to the upper 32 at a later time.

In accordance with a preferred method of forming a footwear sole 10 and an article of footwear 30 according to the present invention, a first layer mold (not shown) is first provided. The mold may be a closed injection mold or an open mold that liquid material is poured into and then shut. A display element 18 is temporarily attached to the section of the mold that will form the upper surface 16 of the first layer 12. When the first layer 12 will have a non-flat upper surface 16 (e.g., as illustrated in FIG. 4), it is preferable that the display element 18 be stretchable so that the display element 18 will contour to the shape of the non-flat mold.

The mold is then filled with liquid first layer material, which contacts the display element 18. Preferably, the liquid first layer material at least partially permeates the entire lower surface 24 of the preferably porous display element 18. This ensures that the entire display element 18 is integral with the first layer 12 after the first layer 12 hardens due to pressure, time, and/or other forces. If the liquid material permeates and passes through a portion of the display element 18, the display element 18 will be partially or wholly embedded in the first layer 12. If the liquid material fully permeates the lower surface 24 of the display element 18 but does not pass through the display element 18, the upper surfaces 16, 22 of the first layer 12 and the display element 18 will be coextensive (i.e., the upper surface 22 of the display element 18 will define the upper surface 16 of the first layer 12). The upper surfaces 16, 22 of the first layer 12 and the display element 18 will be partially coextensive if the display element 18 is partially embedded in the first layer 12 and the rest of the lower surface 24 of the display element 18 is permeated (i.e., the upper surface 16 of the first layer 12 will be defined in part by the upper surface 22 of the display element 18 and in part by the material of the first layer 12). If the display element 18 is fully embedded in the first layer 12, the upper surfaces 16, 22 of the first layer 12 and the display element 18 will be distinct (i.e., the upper surface 16 of the first layer 12 will be formed entirely by the material of the first layer 12).

After the first layer 12 has sufficiently hardened, the first layer 12 is moved to another mold (not shown) where the second layer 20 will be formed. An upper 32 is preferably placed above the first layer 12 with a gap between the upper 32 and the first layer 12 where liquid second layer material will be injected to form the second layer 20. As the second layer 20 hardens, the upper 32 and the first layer 12 are directly attached to the second layer 20. In the preferred embodiment, the second layer 20 is at least partially attached to the material of the first layer 12 permeating the porous portion or portions of the display element 18. Those skilled in the art will recognize that other methods may be used to form a sole 10 or an article of footwear 30 in accordance with the present invention such as, for example, forming a unit sole and then attaching an upper 32 to the sole 10 with cement, glue, or another adhesive. It also may be possible to form the sole by adhering the display element 18 to the first layer 12 with an adhesive that preferably at least partially permeates the pores in the display element 18 such that the display element 18 is at least partially adhered to the first layer 12.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, the first layer 12 can have may different shapes and the display element 18 may have many different designs. The embodiments discussed were chosen and described to provide the best illustration of the principles of the present invention and its practical application to thereby enable one of ordinary skill in the art to use the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An article of footwear comprising:

a sole comprising:

a first layer having a lower surface and an upper surface;

a display element integral with and at least partially embedded in the first layer; and a second layer having an upper surface and a lower surface, the lower surface of the second layer being attached to the upper surface of the first layer;

wherein the first layer is at least semi-transparent such that the display element is observable through the first layer; and an upper attached to the upper surface of the second layer and defining a volume for enclosing a wearer's foot.

2. The article of footwear of claim 1, wherein the display element is at least partially porous.

3. The article of footwear of claim 1, wherein the second layer has a first specific gravity and the first layer has a second specific gravity, the first specific gravity being lower than the second specific gravity.

4. The article of footwear of claim 1, wherein the second layer is formed from a moldable material selected from thermoplastic and rubber.

5. The article of footwear of claim 1, wherein the first layer is formed from a moldable material selected from thermoplastic and rubber.

6. An article of footwear comprising:

a sole comprising:

a first layer having a lower surface and an upper surface;

a display element integral with the first layer, the display element being at least partially porous, and a second layer having an upper surface and a lower surface, the lower surface of the second layer being attached to the upper surface of the first layer;

wherein the first layer is at least semi-transparent such that the display element is observable through the first layer and the material of the first layer at least partially permeates the porous portion of the display element and the second layer is at least partially attached to the material of the first layer permeating the porous portion of the display element; and an upper attached to the upper surface of the second layer and defining a volume for enclosing a wearer's foot.

7. The article of footwear of claim 6, wherein the second layer has a first specific gravity and the first layer has a second specific gravity, the first specific gravity being lower than the second specific gravity.

8. The article of footwear of claim 6, wherein the second layer is formed from a moldable material selected from thermoplastic and rubber.

9. The article of footwear of claim 6, wherein the first layer is formed from a moldable material selected from thermoplastic and rubber.

10. An article of footwear comprising:

a sole comprising:

a first layer having a lower surface and an upper surface;

a display element integral with and at least partially embedded in the upper surface of the first layer; and a second layer having an upper surface and a lower surface, the lower surface of the second layer being attached to the upper surface of the first layer;

wherein the display element is observable through the lower surface of first layer; and an upper attached to the upper surface of the second layer and defining a volume for enclosing a wearer's foot.

11. The article of footwear of claim 10, wherein the first layer is selected from a transparent material, a partially transparent material, and a translucent material.

12. The article of footwear of claim 10, wherein the display element is at least partially porous.

13. The article of footwear of claim 10, wherein the second layer has a first specific gravity a d the first layer has a second specific gravity, the first specific gravity being lower than the second specific gravity.

14. The article of footwear of claim 10, wherein the second layer is formed from a moldable material selected from thermoplastic and rubber.

15. The article of footwear of claim 10, wherein the first layer is formed from a moldable material selected from thermoplastic and rubber.

* * * * *